US007958726B2

(12) United States Patent
Ribeiro

(10) Patent No.: US 7,958,726 B2
(45) Date of Patent: Jun. 14, 2011

(54) APPARATUS AND ASSOCIATED METHODS TO GENERATE USEABLE ENERGY

(76) Inventor: Renato Bastos Ribeiro, Porto Alegre (BR)

( * ) Notice: Subject to any disclaimer, the term of this patent is extended or adjusted under 35 U.S.C. 154(b) by 608 days.

(21) Appl. No.: 12/107,913

(22) Filed: Apr. 23, 2008

(65) Prior Publication Data

US 2008/0264052 A1 Oct. 30, 2008

Related U.S. Application Data

(60) Provisional application No. 60/978,060, filed on Oct. 5, 2007, provisional application No. 60/913,619, filed on Apr. 24, 2007.

(51) Int. Cl.
*F03C 1/00* (2006.01)

(52) U.S. Cl. ..... 60/495; 60/496; 415/203; 415/206

(58) Field of Classification Search ..... 60/495–496; 415/203, 206; 416/183, 185
See application file for complete search history.

(56) References Cited

U.S. PATENT DOCUMENTS 3,865,506 A * 2/1975 Gerlach ..... 415/225
4,243,357 A * 1/1981 Flynn et al. ..... 415/218.1
4,326,132 A * 4/1982 Bokel ..... 290/1 R
5,944,480 A 8/1999 Forrest
2003/0145589 A1* 8/2003 Tillyer ..... 60/496
2007/0201974 A1* 8/2007 Dev ..... 415/77
2007/0283689 A1 12/2007 McGahee

OTHER PUBLICATIONS

"Buoyancy" reference from Wikipedia, the free encyclopedia. Retrieved on-line Apr. 30, 2008: http://en.wikipedia.org/wiki/Buoyancy.

* cited by examiner

*Primary Examiner* — Hoang M Nguyen
(74) *Attorney, Agent, or Firm* — Greenberg Traurig, LLP

(57) ABSTRACT

The present disclosure relates to an apparatus and associated methods for generating energy by capturing and taking benefit of the energy generated by any quantity of air surfacing inside water. In exemplary embodiments, the apparatus comprises compressing a lower density gas in a liquid medium, allowing the gas to naturally rise to the surface of the liquid medium and then capturing the energy generated by the surfacing gas. An apparatus and method is disclosed to provide a low energy technique to compress air into water. In exemplary embodiments, air is introduced into water by simultaneously providing a low pressure area in the liquid medium and compressing the air into the low pressure area. By compressing the air into water in low pressure areas, the energy required to compress the air is greatly reduced. The amount of energy generated by the rising air is less than the amount of energy required to compress air underneath the water.

34 Claims, 13 Drawing Sheets

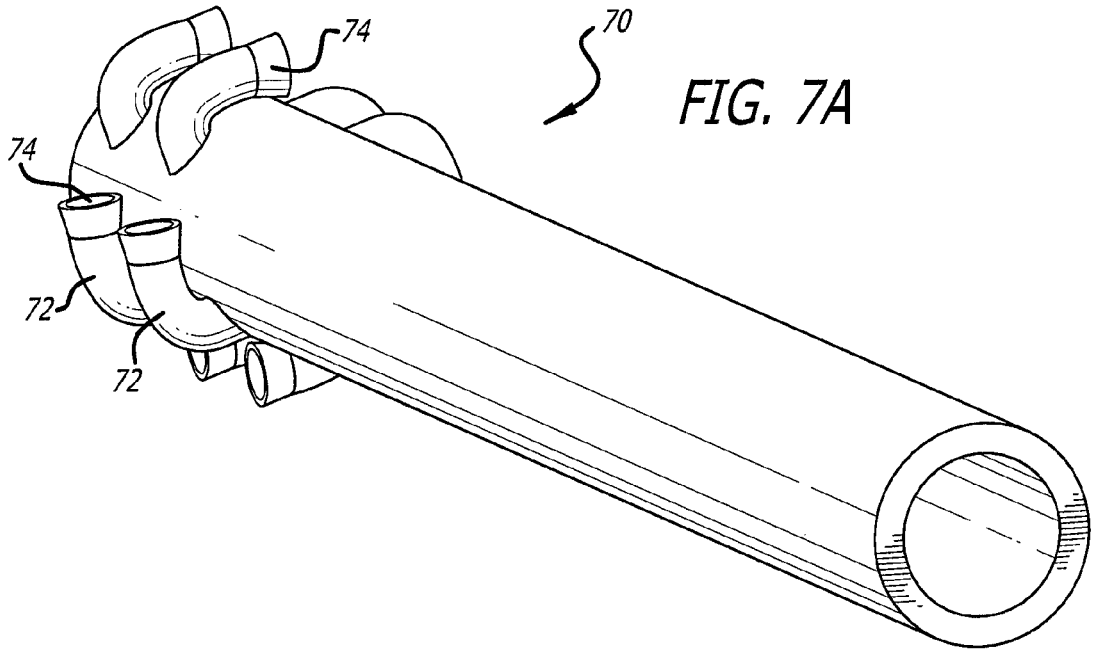
FIG. 7A
FIG. 7B
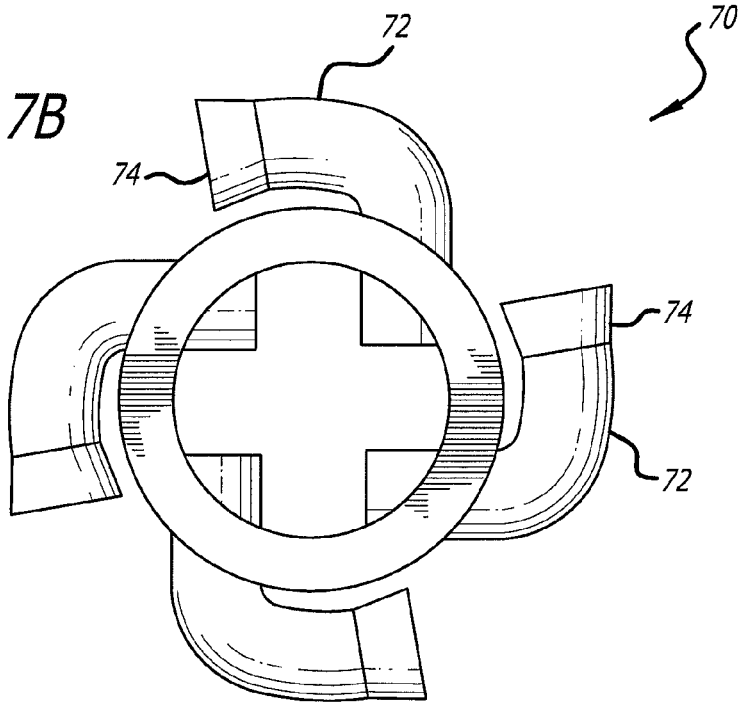

FIG. 8
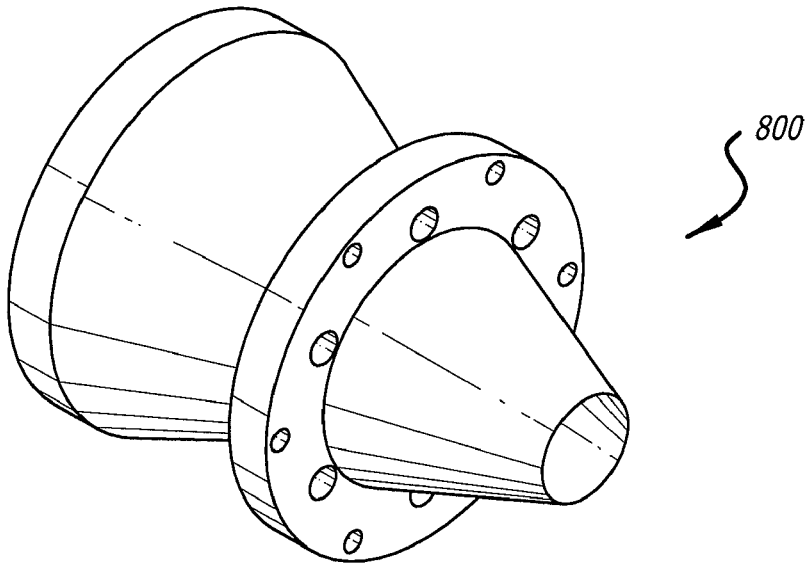
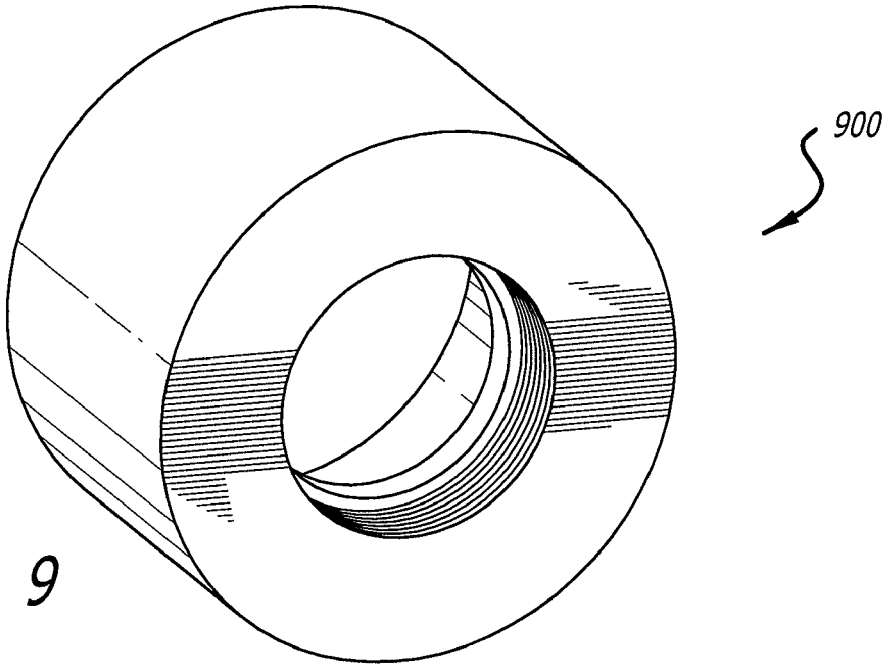
FIG. 9

APPARATUS AND ASSOCIATED METHODS TO GENERATE USEABLE ENERGY

CROSS REFERENCE TO RELATED APPLICATIONS

This application claims the benefit of priority of U.S. Provisional Patent Application No. 60/913,619, filed on Apr. 24, 2007, entitled ENERGY CREATION and U.S. Provisional Patent Application No. 60/978,060, filed on Oct. 5, 2007, entitled APPARATUS AND ASSOCIATED METHODS TO GENERATE USEABLE ENERGY, the contents of which are hereby incorporated by reference herein in their entirety.

BACKGROUND

1. Field

The present disclosure is related to the generation of electrical energy, and more particularly the conversion of kinetic energy in rising air bubbles through water into usable electrical energy.

2. General Background

Energy costs and concerns have highlighted the need for alternative and renewable energy sources. Recent research into different methods of producing energy involving the traditional uses of wind, water, and solar energy has been widespread, This reflects the major threats of climate change due to pollution, exhaustion of fossil fuels, and the environmental, social and political risks of fossil fuels.

One potential source of renewable energy is the kinetic energy created by rising air in water. Air rises in water because it is less dense than water, meaning that a given volume of air weighs less than the same volume of water. Water is nearly 1,000 times denser than air. Any object or substance that weighs less than the amount of fluid it displaces will float on that fluid.

Buoyancy is the upward force on an object produced by the surrounding fluid (i.e., a liquid or a gas) in which it is fully or partially immersed, due to the pressure difference of the fluid between the top and bottom of the object. The net upward buoyancy force is equal to the magnitude of the weight of fluid displaced by the body. This net force enables the object to float or at least to seem lighter.

Buoyancy provides an upward force on the object. The magnitude of this force is equal to the weight of the displaced fluid. The buoyancy of an object depends, therefore, only upon two factors: the object's volume, and the density of the surrounding fluid. The greater the object's volume and surrounding density of the fluid, the more buoyant force it will experience. If the buoyancy of an unrestrained and unpowered object exceeds its weight, it will tend to rise. An object whose weight exceeds its buoyancy will tend to sink. This buoyant force on air bubbles in water causes the air bubbles to rise to the surface.

Thus, there is a need to provide an apparatus and associated methods wherein air is compressed into water at low energies and the kinetic energy created by the surfacing air is generated into useable energy.

SUMMARY

In one aspect of the present disclosure, a method and apparatus for generating energy is disclosed. The basic method comprises first introducing air into water below the surface of the water. Then the air bubbles in the water are allowed to rise to the surface. To generate energy, the kinetic energy in the upwardly moving and subsequently surfacing air bubbles is captured and converted into a useable form of energy.

In another aspect, there is disclosed an apparatus and method to compress air into water with minimal expenditure of energy. In exemplary embodiments, air is introduced into water by simultaneously providing a low pressure area in the liquid medium and compressing air as it is introduced into the low pressure area. By compressing the air introduced into water in low pressure areas, the energy required to compress the air is greatly reduced. At the same time the air in the water is forced outward to a peripheral location where the air is then released in the form of bubbles that then rise to the surface.

There are several different methods to compress air into water in accordance with the present disclosure. One apparatus capable of compressing air into water comprises providing a circular rotor on an axle in the water. The rotor may have a plurality of teeth on an outer edge of the rotor and a cavity formed within the rotor for the introduction of air into the water. In exemplary embodiments, the rotor forming the cavity comprises a plurality of blades extending towards the outer edge, with each of the blades ending in an orifice in the teeth of the rotor.

To introduce the air, the rotor is rotated, for example, in a counter-clockwise direction to produce an area of lower pressure adjacent to each tooth or peripheral end on the outer edge of the blade to provide a low pressure region or vacuum for low energy compression of air into the water. Air is then introduced at that region. Since this end region is at a low pressure, a compressed volume of air may be easily introduced with minimal expenditure of energy.

In another embodiment, a cylinder attached to an axle is placed in the water. The cylinder may have a plurality of streaks or channels along the circumference of the cylinder and a plurality of orifices in each cylinder. A cavity formed in the cylinder has a plurality of blades extending towards each streak in the cylinder terminating in an orifice. To introduce the air, the cylinder is rotated to produce an area of lower pressure at each streak on the outer edge of the cylinder to provide a vacuum for the introduction of air.

In another further embodiment, a pipe enclosing an axle with lateral ducts in the form of a spiral, the ducts terminating in blades extends into the water. The axle is rotated within the pipe to produce an area of lower pressure at each blade on the end of the axle to provide a vacuum to allow for the introduction of air.

In a further aspect of the present disclosure, an apparatus generating usable energy from the air or other gas compressed into the water or other fluid per the present disclosure. The apparatus may preferably include a vertical tank filled with a liquid medium and a compressor to introduce a gas having a lower density than the liquid medium into the liquid medium. Air introduction equipment is utilized to provide a low pressure area in the liquid medium for low energy compression of the gas.

In this embodiment, the gas compressed into the liquid medium naturally rises and an energy conversion mechanism attached to an energy conversion axle, the energy conversion mechanism able to capture the rising and surfacing gas. Finally, a generator is attached to the energy conversion axle to convert the kinetic energy in the surfacing gas into usable energy.

In exemplary embodiments, the energy conversion mechanism comprises a pair of gear or pulley wheels, a chain or belt extending between the wheels and capable of rotating the wheels; and a plurality of upside down cups attached to the chain or belt to capture the surfacing gas at the bottom of the tank or column. The cups capture the escaping air or gas, displacing water or other fluid in the upside down cups, resulting in an upward buoyancy force being exerted on the cups attached to the belt or chain, causing upward movement of the gas containing cups. When the cups reach the top gear or pulley wheel, they each rotate about a horizontal axis, releasing the air or gas, and then returning right side up down to the bottom pulley wheel to once again collect escaping gas or air when upside down. The upper pulley wheel drives another pulley wheel that in turn turns a generator rotor to produce useable electrical energy.

DRAWINGS

The foregoing aspects and advantages of the present disclosure will become more readily apparent and understood with reference to the following detailed description, when taken in conjunction with the accompanying drawings, wherein.

Figure 6A:
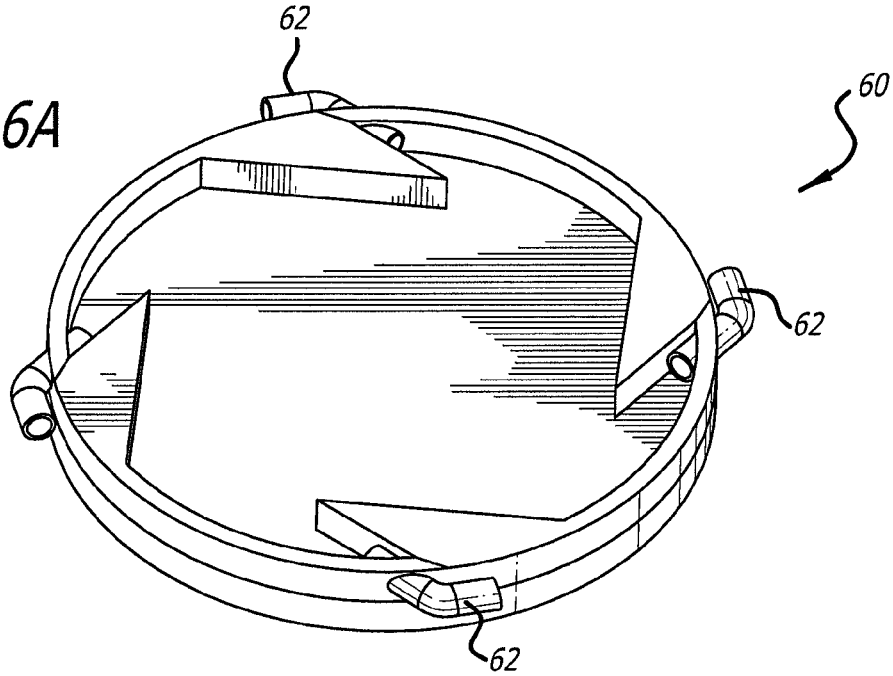

FIG. 6*a* is an upper plan view of an alternative rotor design in accordance with the present disclosure.

Figure 6B:
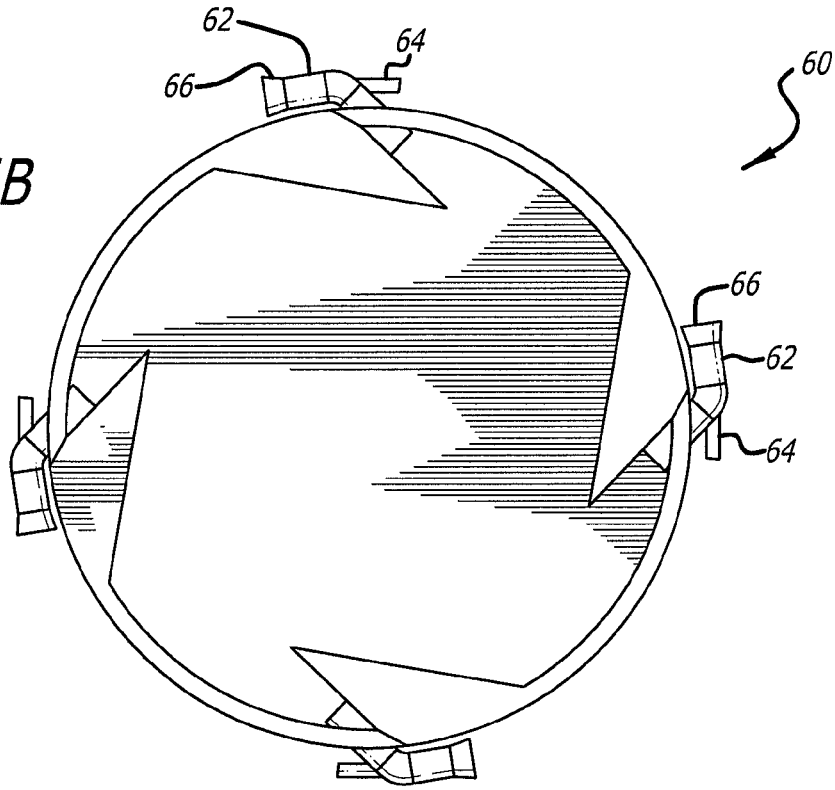

FIG. 6*b* illustrates a plan view of another alternative rotor design in accordance with the present disclosure.

FIG. 7*a* is a perspective view of a tubular rotor design in accordance with the present disclosure.

FIG. 7*b* is an opposite end perspective view of the tubular rotor design shown in FIG. 7*a*.

Figure 14:
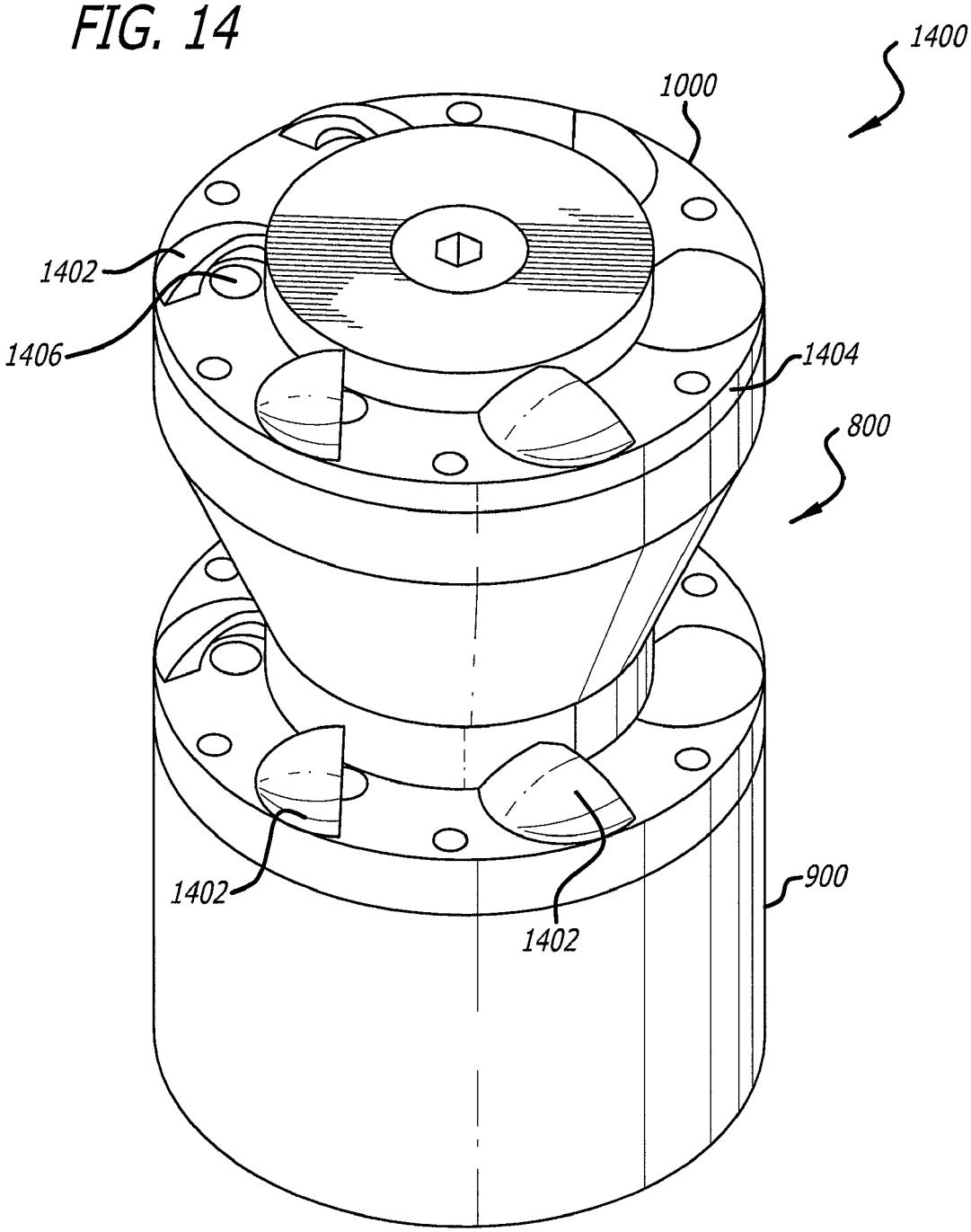

FIG. 8 is a separate perspective view of a flanged cone part of the screw rotor assembly shown fully assembled in FIG. 14.

FIG. 9 is a separate rear perspective view of a tubular cylinder that is fastened to the flanged cone shown in FIG. 8.

Figure 10:
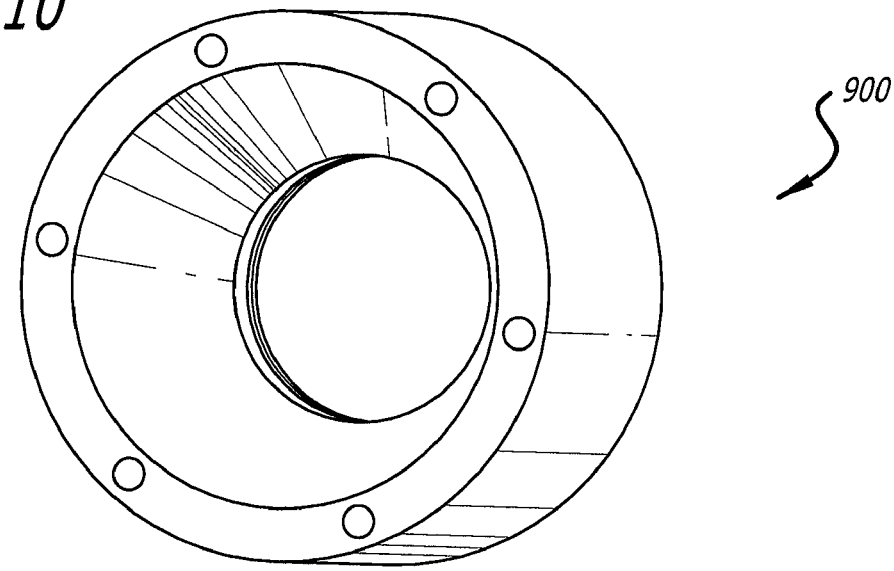

FIG. 10 is a separate front perspective view of the tubular cylinder shown in FIG. 9.

Figure 11:
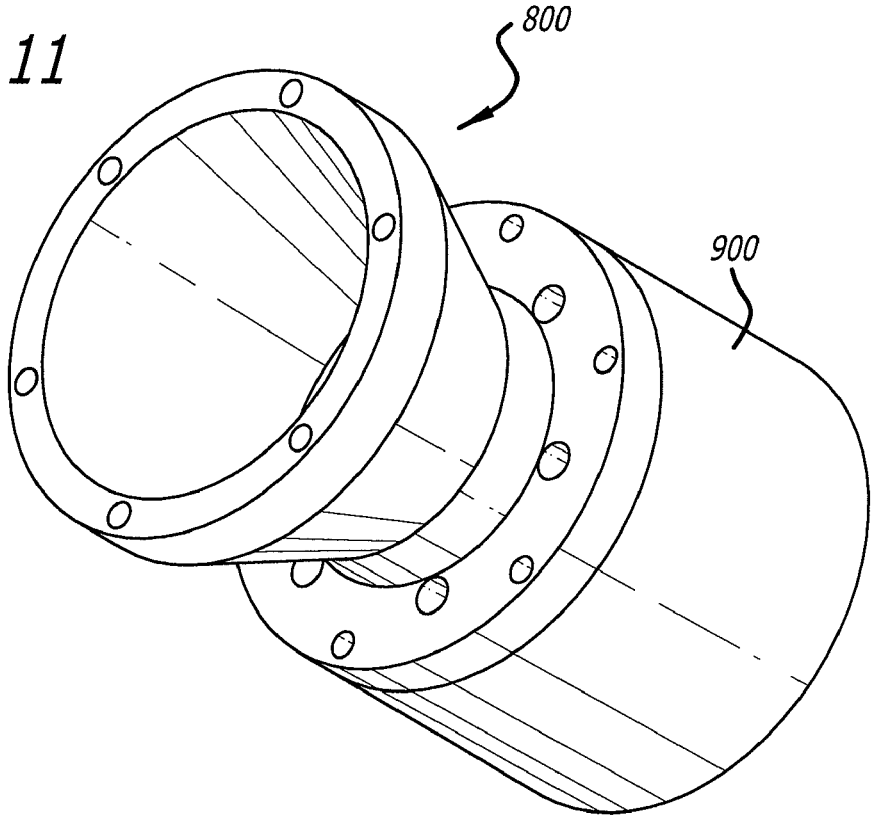

FIG. 11 is a perspective view showing the parts shown in FIGS. 8, 9, and 10 assembled together.

Figure 12:
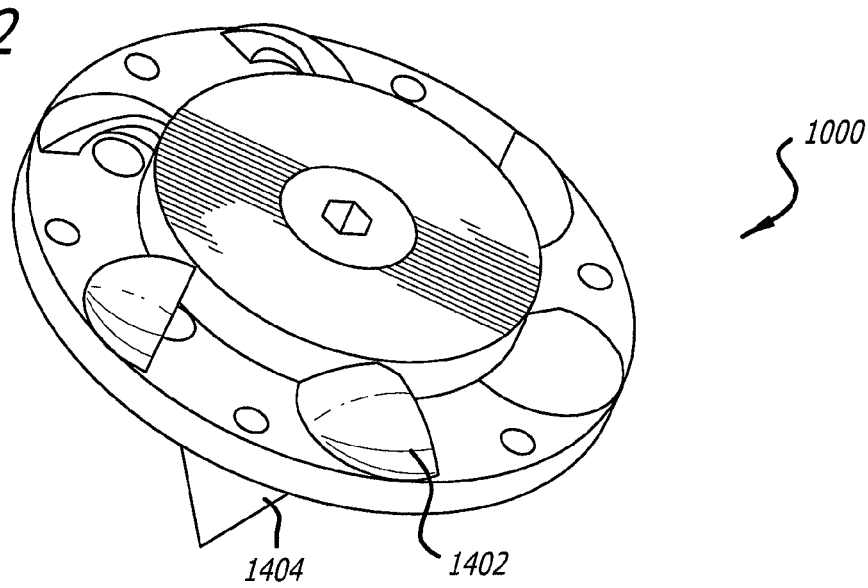

FIG. 12 is a separate perspective top view of a cone part which is inserted into the conical cavity in the cone part shown in FIG. 8, as shown in FIG. 14.

Figure 13:
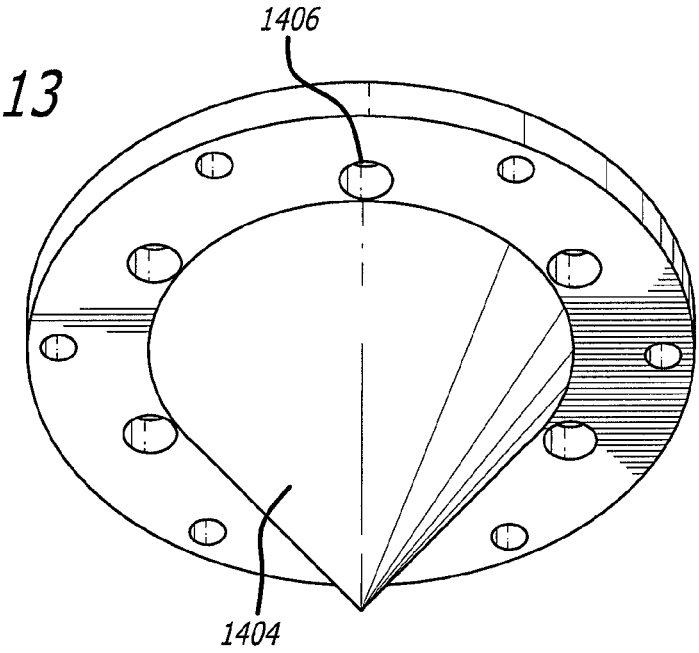

FIG. 13 is a separate perspective bottom view of the cone part shown in FIG. 12.

FIG. 14 is a fully assembled perspective view of the alternative screw rotor disc embodiment.

Figure 15:
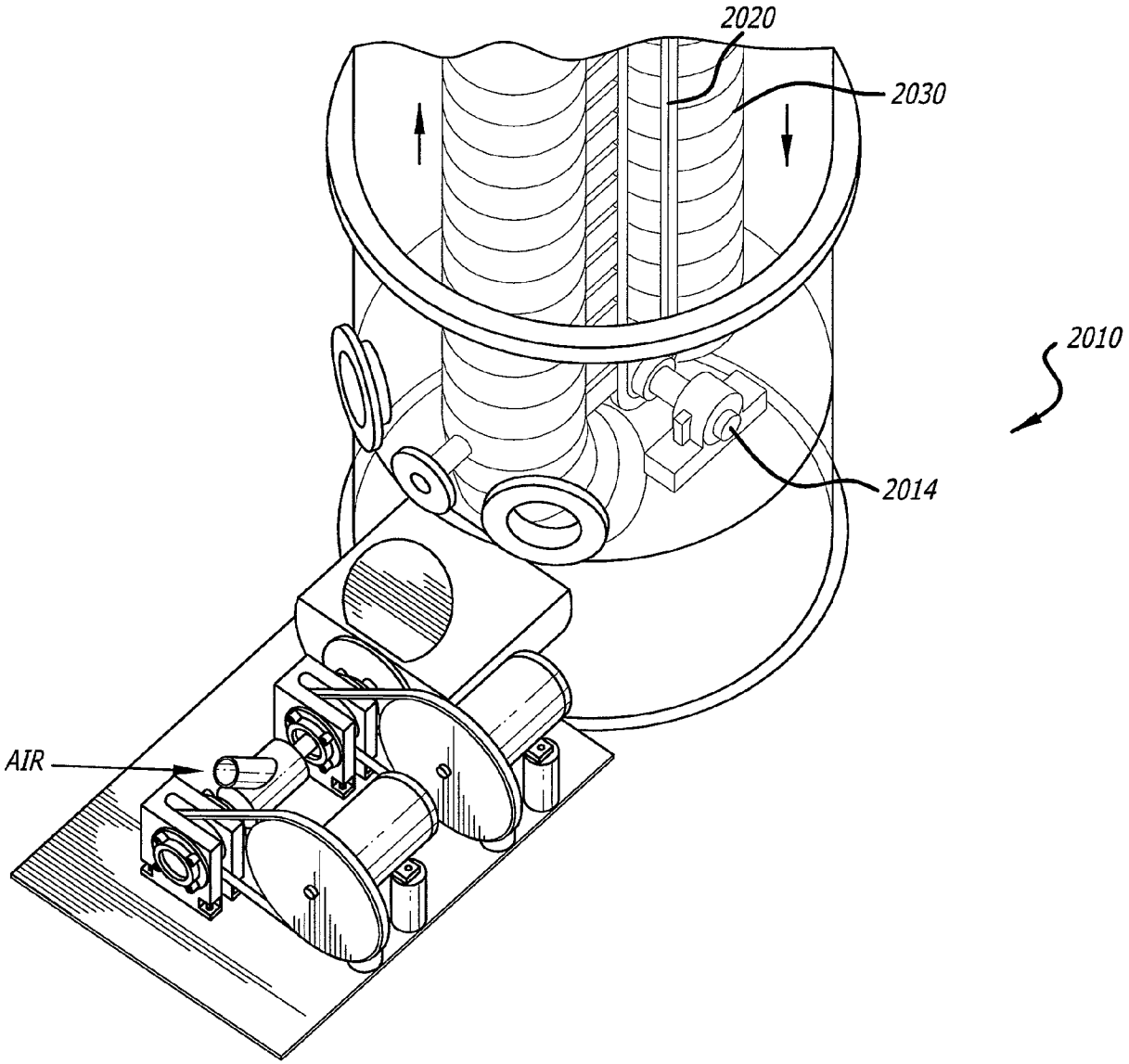
Figure 18:
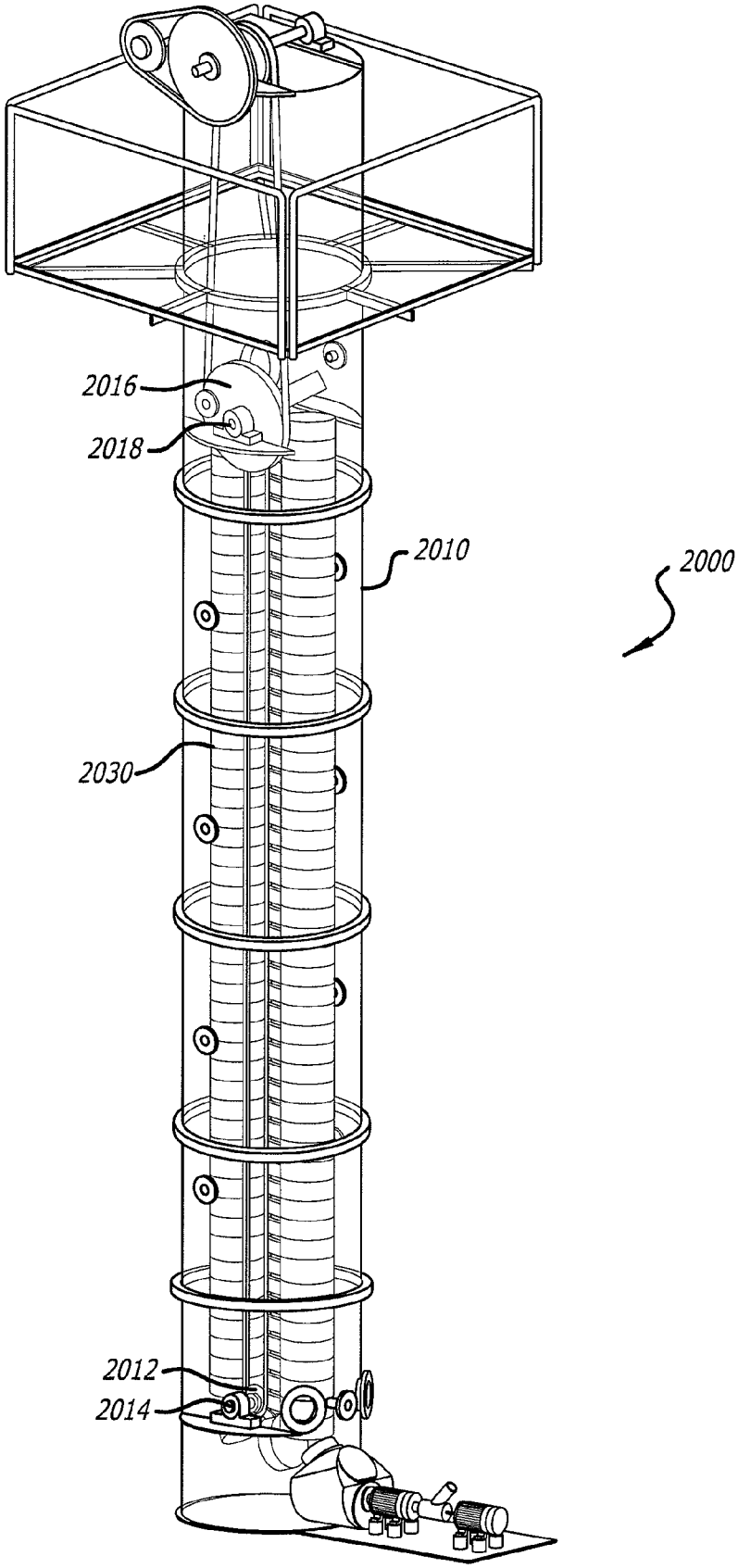

FIG. 15 is a perspective view of the bottom portion of the assembled energy production apparatus shown in FIG. 18.

Figure 16:
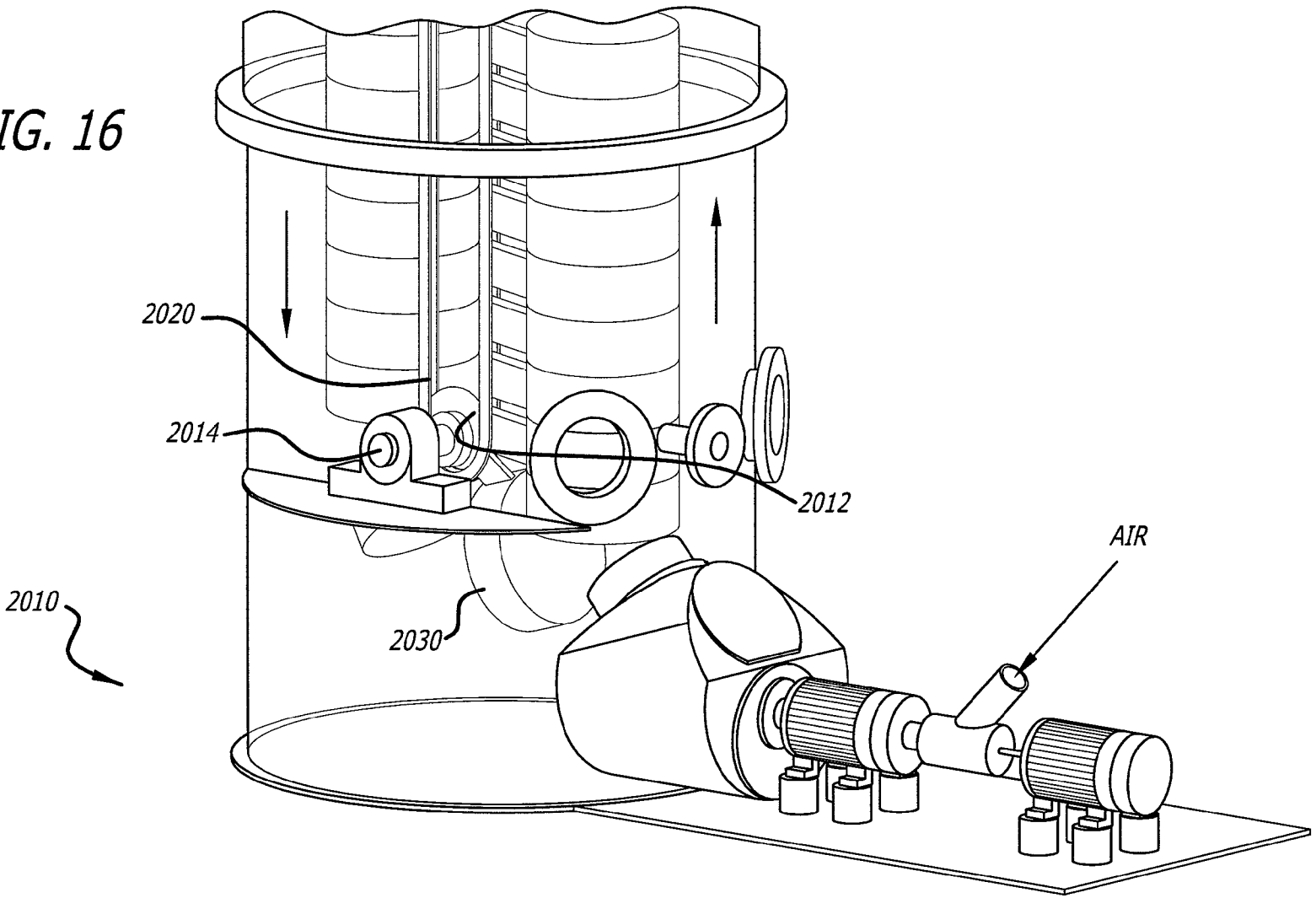

FIG. 16 is a perspective view of the bottom portion of an alternative energy production apparatus to that shown in FIG. 18.

Figure 17:
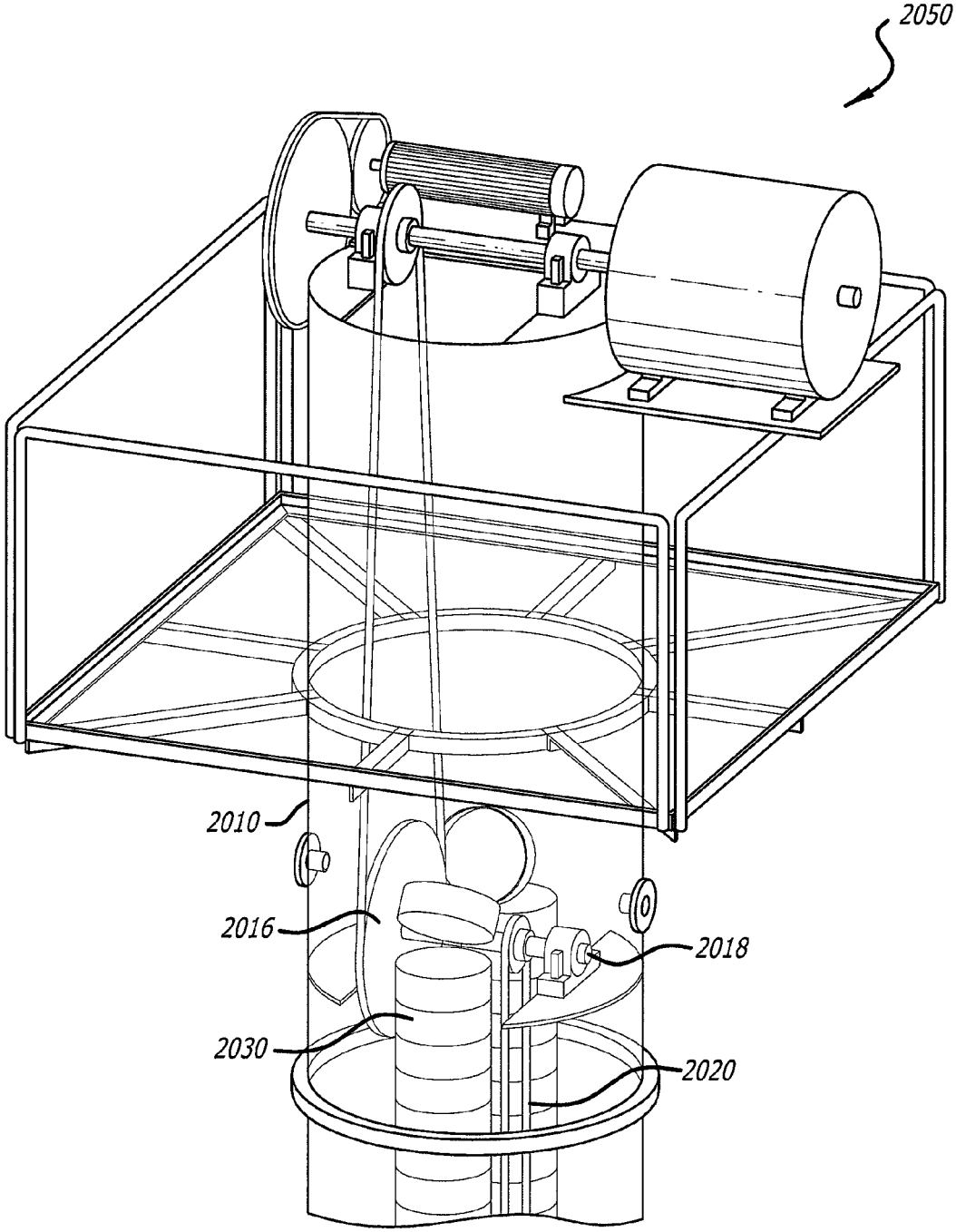

FIG. 17 is an enlarged view of the upper portion of the apparatus shown in FIG. 18 illustrating a detailed view of one exemplary embodiment of a portion of the energy conversion mechanism.

FIG. 18 is a perspective view of one embodiment of the energy conversion system in accordance with the present disclosure.

DETAILED DESCRIPTION

The present disclosure refers to a system or a process with the goal of creating a new and clean energy, capture this energy and make it available for general use. This disclosure is formed by two stages that work integrated in this case. However, each of the stages involves a complete technology and could be used separately or together.

The first stage consists in the creation of energy with the introduction of "air" at the bottom part of a water column. Once introduced, the air creates a proper energy when moving towards surface direction.

This technique is well known and applied usually for several ends, as for example to raise objects from the bottom of a river or sea to the surface as boats, submarines, etc. Attaching tanks on those objects and introducing air, they are driven to float at the surface. This operation and this kind of air introduction would not bring any results to attain goals of the present disclosure.

At the present disclosure, the air introduction should be made by a new method, a new idea and conception which makes possible to introduce air with a very low cost of energy. Initially the present disclosure is about introducing air at the bottom of a water column formed by a common tank, and the introduced air at the inferior part is simply launched into water, forming bubbles that will have its own energy when freely moving towards surface.

The air introduction into water is the main point of this first part of the disclosure. A method and a conception were created which result in very specific function and effects, in order to spend or use a very small quantity of energy. I created three models of the rotor, two in the disk or cylinder form and another in the form of a screw. In any of those cases there are teeth or salience in specific points as we are able to see in the attached drawing FIGS. 1-18. When the rotors are turned in the water those salience or teeth create effects that consist in the removal (moving away) of water from the interior part of the teeth, which allow the introduction of air at this point. The conception of those teeth as well as their function when turning inside water is to create the effect of breaking pressure that exists at that point and with that, allow the formation of a vacuum where the air is introduced.

At figure number 1 we can see a red disk. This part is one of the laterals of the disk. At the central part there is a hole to support an internal rotor axle. Over the red disk we can see at FIG. 1, in the green color the central part of the disk with parts that have the function of capturing the air inside the disk and pushing the same air through the hole protected by the external tooth. When the disk is turned counter-clockwise the external tooth removes (moves away) water and breaks pressure at the internal part of the tooth, exactly where the air has been pushed. In order to understand perfectly it is needed to imagine the function of the tooth, which is to move away (remove) water from the interior part in a conjugated and synchronized way with the air introduction. When the disk is turned counter-clockwise both things happen at the same time, continually. As they are continuants, they are automatically synchronized and one function allows the other to happen and vice versa. So, it is only possible for the tooth to move away (remove) water from the interior part because air has been introduced at the same moment and at the same point. Without air introduction, water would not move away and the pressure would not be broken. In the same way it is only possible to introduce air with low energy cost if pressure is broken by moving away water in the interior part of the tooth and at the air introduction point. In this function, the effect created from the tooth and the air introduction comprises the concept and conception of the disclosure.

At the moment when the air is introduced at the internal part of the tooth a new and clean energy is created. The air naturally releases itself from the interior of the tooth by its own energy towards the surface of the water, allowing that another quantity of air fulfills the space where it was before. Therefore, a continuous movement of air entrance is formed at the interior portion of the tooth and a continuous movement of air leaving this place towards surface.

Figure 2:
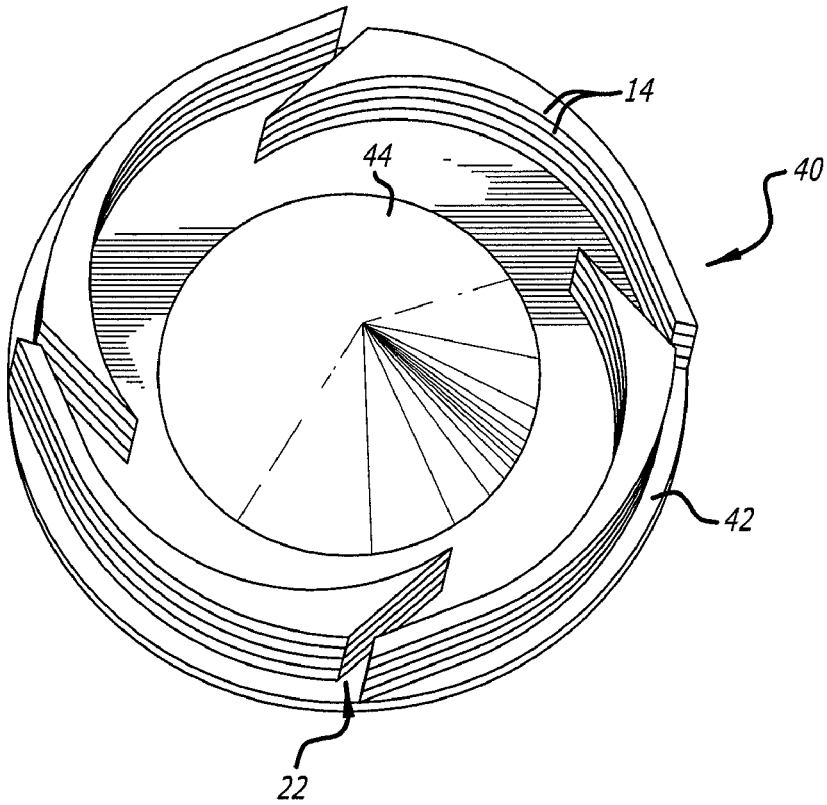
FIG. 2 is a perspective view as in FIG. 1 of another exemplary embodiment of a rotor disc for generating a low pressure region for compressing a gas into a liquid medium.

At FIG. 2 we can see that the tooth can be extended in the form of a cylinder and also a cone to spread the air. At FIG. 3 we can see the disk with another lateral in the color transparent blue with a central hole where the disk is fixed at the axle, and the air enters by the center of this axle. The disk rotation at the inferior part of the water column is already enough to introduce the air inside water. With the disk rotation the air is pulled through the internal part of the axle and pushed to the internal part of the tooth, acquires own energy and moves towards surface. This system spends very low energy. This energy is much inferior to the energy created by the air moving from the interior part of the tooth towards surface, and this difference results in the gain of clean and new energy created, which is the goal of this disclosure.

Figure 4:
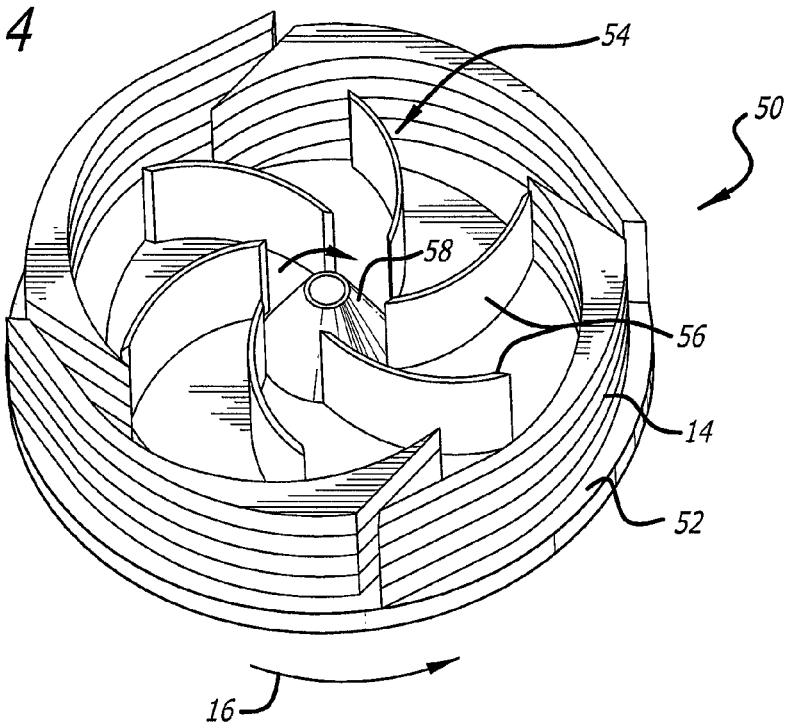
FIG. 4 is a perspective view of an alternative rotor disc which includes a counter rotating central impeller.

In the interior of the disk, according to the case, we can put a fan rotor with blades, FIG. 4. This rotor is started by an axle that goes inside a bigger axle and is supported in the internal roller bearing that is in the lateral as per FIG. 1, FIG. 5 and at the external activating. When it is turned clockwise, therefore in an inverted rotation from the external part of the disk, the rotor has the function of speeding the movement of air introduced inside water and towards water surface.

We have a second model of the tooth in the form of a disk where we change the tooth form. In this case the disk would have its face rounded, even and without teeth. The internal part is the same as the previous disk and at the air exit point outside the disk we put a small round tube with a small curve matching the air exit alignment and at the external part, the cylinder circumference alignment. At the edge of this small tube we will have an enlargement of the wall. At FIG. 6 we can see this conception, applying the concept that in this tubular format at the air exit point, it makes it easier to make vacuum with the rotation of the disk and so, increasing the air transit from inside the disk to outside and from there to the surface.

In this case we still have the option to add another tube of small diameter which, with the disk rotation, would allow the water transit inside the tube, helping to move (carry) the air to the vacuum zone at the edge of the tube and from there to surface as we can see on FIG. 7.

The third model is similar to a screw as we can see in FIGS. 8-14. The assembled screw rotor is shown in FIG. 14. FIGS. 8, 9 and 10 show separate perspective views of the parts of the screw assembly. FIG. 8 is a flanged cone part 800 of the screw rotor assembly. FIG. 9 shows an inside perspective view of the tubular sleeve 900 that is fastened to the flanged cone 800 shown in FIG. 8. At FIG. 10 we see the same part 900 from an opposite perspective view and at FIG. 11 the two parts 800 and 900 are assembled together. A cone shaped impeller 1000 is shown in top and bottom views respectively in FIGS. 12 and 13. The impeller 1000 is assembled into the cone 800 shown in FIG. 11. This cone 1000 has a complementary cone portion 1404 which fits into the cone 800. The impeller 1000 sends air to the entrance holes 1406 into water and teeth 1402 at the external part in the form of a part of a bottom. At FIG. 14 we can see the set 1400 assembled and including the teeth 1402 at the central part. These teeth 1402 at the central part show that we can make other central surfaces or other levels with the finality of increasing the number of teeth.

Once the screw rotor is turned (spun) at the inferior part of the water column, all happens in the same concept and the same conception of the tooth of the disc rotor or the tooth formed by the small tube. The spin of this screw 1400 will promote the water to move away (removal) from inside the teeth 1402. This removal is possible because at the same moment and at the same point, the air is introduced and breaks pressure, allowing the air introduction at the interior part of the tooth. The air creates its own energy and is released from the interior of the tooth towards surface, forming a continuous movement.

In this case we can also substitute the teeth 1402 that we can see at the FIG. 14 by small tubes 72 such as are shown in FIGS. 7*a* and 7*b* with some curving that will allow the match with the air exit point and along the way of the rotor circumference.

Many variations in the rotor structure could be used to introduce the air into water. Thus any kind of tooth or salience may be used that causes a pressure break in a certain point inside the liquid, e.g. water, that facilitates the air introduction at the same time that water moves away. The water moves away because there is air to be pulled and so the water moves this air that goes towards surface. Here we have a specific function that generates the desired effect. This results in air introduction at the bottom of the water column with a small cost of energy. This cost is less than the energy created naturally during the path of the air towards the surface.

The rotating movement of this rotor either in the form of a disk, with teeth or with small tubes at the exit, as well as in the form of a screw also with teeth or small tubes at the exit allow all functions and effects above mentioned and the air is introduced into the water column with a small energy cost, that less than the energy generated as we will see in the second stage as we mentioned initially.

The air introduction at the inferior part of a water column or tank filled with any kind of liquid, can be used for many other goals, for example: the air introduction or any kind of gas in tanks with any liquid, the homogenization or fastener of any liquid in tanks and many other functions/use.

In order to spin any of the types of rotors at the inferior part of the water column, a system with two engines that are connected by belts in the two axles may be utilized. In the bigger axle is connected the external part of the disk rotor or screw rotor and when it is the case, in the smaller axle, the internal ventilator of the disk. This system that is presented at FIG. 15 allows the two axles to spin in any direction and in high rotation, as well as to choose different rotation for each one of the axles. Any of the rotors are inside a small tank that is at the external wall of the water column. The air that leaves from any of the rotors naturally moves through the superior part of the small tank to inside the water column. When we are not using the fan small axle, we can just use the set of engine and bearing which are beside the water column.

When the disk rotor model or screw rotor does not need high rotation, I projected the model of FIG. 16 where we have only the two engines. The bigger axle is the same axle of the engine next to the tank. In this case, the air is passing inside the tubular engine axle to get to the rotors. When it is applicable, a second engine where the smaller axle is supported starts this axle that passes inside the other engine axle, spinning the internal fan. This is a much simpler system, but the maximum rotation is limited to the engine rotation. At FIG. 16 we can see clearly that the air while releasing from any of the rotors, naturally moves inside the water column.

Capturing and Making Available the Air Energy Inside Water While Moving Towards Surface This portion of the present disclosure refers to a system with the objective of capturing the air that was put at the inferior, i.e., lower, part of a water column or tank while moving towards water surface. This is the second stage of the total project in a separate way. Because, besides the air introduced in the bottom of the water column, at the first stage of the whole process as above described, there are other sources or air or gases in many types of industries, which are released into the atmosphere due to low pressure. These air or gases of lower pressure can be directed in the present disclosure and used for the creation of energy. For this reason, this disclosure, although it is the second stage of the set, has a proper utilization.

It is not known nowadays any technique with the objective of capturing air inside water, use its energy and make this energy available for general use.

The goal of this disclosure is to capture any quantity of air that exists in any way inside a water column or tanks in general, rivers and dams and to use the energy that this air has while moving towards water surface.

FIGS. 15-18 show an exemplary tank that we call "water column" 2010 where we can see at the bottom of the tank the described equipment to introduce air inside water. It is important to clarify that although in the disclosure here, we refer to water as the internal liquid of the tank, we also could use a very thin mineral oil, or mix a soluble mineral oil into water to promote lubrication and avoid rust.

This disclosure consists in driving the air to the interior of the buckets that are fixed in a chain. This chain moves supported by two axles over bearings. Those buckets 2030 that we can see in FIGS. 15 and 16 make an ascending movement while they are filling with air. Still at FIGS. 15 and 16 we can watch all system of the inferior part of the water column. The buckets 2030 go down lined at the descendent side of the chain 2020, make the turn at the inferior axle 2014 and line up again at the ascending side of the chain. After turning around the inferior axle the bucket 2030 receives the airflow. We can also see the serrated wheel 2012 that supports and guides the chain 2020, the chain 2020, the bearings, and a curved plate which has the function of driving air inside the buckets 2030.

At FIG. 17 we can see the system at the superior part of the water tank 2010 the buckets 2030 rising at the ascending point filled with air, turning around the superior axle 2018 and, at that point, releasing air at the water surface and entering the descendent side, to return to the inferior axle and to be again loaded with air. We can see the axle 2018, the buckets 2030, bearings and the (transparent) tank body 2010. Still at FIG. 17 the primary axle 2018 with an estimated rotation at 120 rpm is pointed by an arrow. Just above is the water level. The energy captured in the air that exists in the inferior part of the column of water or tanks, dam, rivers, etc. will be available at the primary axle. The present disclosure is concluded with the generation of energy at the primary axle 2018.

Still at FIG. 17 I am showing the transmission of this energy to an axle at the top of the water column where we have a generator 2050 for a rotation of 300 rpm plus an engine connected to another generator with rotation of 600 rpm. This part of the FIG. 17 is only illustrative to show that we shall generate energy at the primary axle at 120 rpm, or use any kind of transmission to more convenient rotations.

It is possible to project other kinds of mechanisms to capture the energy of air inside water while moving towards surface. However, I require and claim the patent registration for the second part of this project, which consists of the creation and conception of a concept which is to capture this energy and for the function that creates the effect of joining this energy and makes it available in an axle or in another way that it could be used. I require and claim this patent in a separated way and also together with the first stage of the system. I repeat once again that it is not only the air or gases introduced in the method of the first stage that could be used in the second stage. All forms of air or gases with small pressure that today are lost in the atmosphere can be directed to a water column and generate energy following the presented disclosure.

Further Detailed Description

The present disclosure relates to an apparatus and associated methods for generating energy by capturing and taking benefit of the energy generated by any quantity of air surfacing inside water. In exemplary embodiments, the apparatus comprises compressing a lower density gas, such as air, in a liquid medium, such as water, allowing the gas to naturally rise to the surface of the liquid medium and capturing and taking benefit of the kinetic energy generated by the upwardly moving and surfacing gas.

It should be appreciated that for simplicity and clarity of illustration, elements shown in the Figures and discussed below have not necessarily been drawn to scale. For example, the dimensions of some of the elements are exaggerated relative to each other for clarity.

FIG. 18 illustrates an exemplary embodiment of the overall apparatus in accordance with the present disclosure. The apparatus 2000 includes a kinetic energy to electrical energy conversion portion and a low energy consumption air or gas compression portion located at the bottom of a tank in the form of a vertical column 2010. The low energy consumption air compression portion will be discussed further below.

Near the bottom of the column 2010, there is a chain or pulley wheel 2012 bearing supported on a fixed transverse axle 2014. Near the top of the column 2010 another serrated chain wheel or pulley 2016 is attached to a bearing supported fixed transverse axle 2018. A chain or belt 2020 connects the two serrated wheels 2012 and 2016. The wheels and the chain produce a minimum amount of friction when moving inside the water or other fluid. The top serrated wheel rotates about an axle at the center of the top wheel. An endless chain or stack of upside down cups 2030 are supported by the belt or chain 2020 such that as the chain 2020 moves around the pulleys 2012 and 2016, the cups, upside down, move from bottom to top, flip over, then from top to bottom of the column 2010. The driving force for the movement of the cups and hence the chain or belt 2020 is provided by air or gas bubbles caught and carried in the upside down cups 2030 as they move from bottom to top of the column 2010 via the buoyancy force applied to the cups by displacement of water or other fluid within the cups.

At the top of the column 2010, a mechanical linkage is provided from the wheel 2016 to the rotor of an electrical generator 2050 as described in more detail below. However, at this point of the description, it should be noted that this portion, shown in FIGS. 17 and 18, provides the kinetic energy to electrical energy conversion portion of the apparatus.

In order for an energy generation apparatus to be a useful and efficient generation system, the energy input requirement ideally must be less than the output requirement. In the present disclosure, there is provided an apparatus for compressing gas into a transfer liquid simply and with minimal consumption of energy. The process basically involves introducing air or gas into the liquid at a point of extremely low pressure within the liquid, so low as to be known as a pressure break region.

In accordance with the present disclosure, a unique apparatus for compressing gas into a liquid such as water and then releasing such compressed gases such as air using very low energy for compression of the gases is presented. This apparatus is overall shown in the enlarged bottom end views of the column 2010 shown in FIGS. 15 and 16. More particularly, the actual mechanisms for compression of gases into the liquid are shown with reference to FIGS. 1 through 14.

Figure 1:
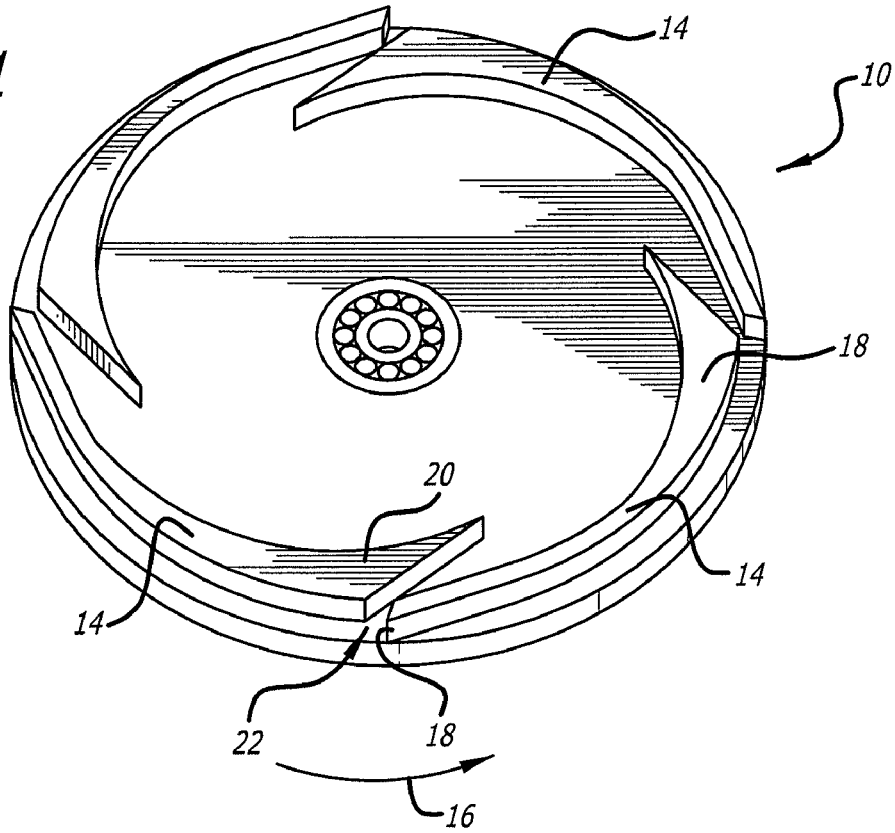
FIG. 1 is a perspective upper view of an exemplary embodiment of a rotor disc for compressing a gas into a liquid medium.

FIG. 1 shows a top perspective view of a first embodiment of an impeller disc 10 in accordance with the present disclosure. The impeller disc 10 is a circular flat disc that has a series of peripheral vanes 14 thereon. The disc 10 has a central hole 12 surrounded by a roller bearing 13. Rotation of the rotor or impeller disc 10 is counterclockwise as shown by arrow 16. The trailing end of each of the vanes 14 forms a tooth 18. The leading tip 20 of the vane 14 leads into a very small gap 22 at the outer periphery of the disc 10. Air or gas is introduced into the central region of the disc 10 while the disc 10 is immersed in liquid. In operation, as the disc 10 spins in the direction of arrow 16, water and air together is scooped into the narrowing passage causing an increased pressure toward the gap 22. However, just beyond the narrowest point in that passage, the tooth 18 changes angle sharply. As the disc 10 spins, this region adjacent tooth or tip 18 is at very low pressure causing any air compressed in the liquid to be released. Because the spinning impeller causes the gases introduced therein to be compressed with the liquid, there is very little energy expended in production of this effect. The net result is compression of gas in liquid for little expense. In addition, the expulsion of gas may be directed in useful ways, for example, in the present disclosure, into the bottom region of the column 2010 such that it can be captured in the upside down cups 2030 as briefly described above.

FIG. 2 shows another embodiment of an impeller disc 40 in accordance with the present disclosure. Disc 40 again is a flat disc shaped body 42 that has a series of spaced vanes 14. However, in disc 40, the vanes 14 are stacked together in groups of four, for example, in an axial direction. This stacking gives more volume to the impeller cavity. In addition, a central axial cone 44 is provided. The cone 44 assists in distribution of gas and liquid into the impeller disc 40 during rotation basically as above described with reference to FIG. 1.

Figure 3:
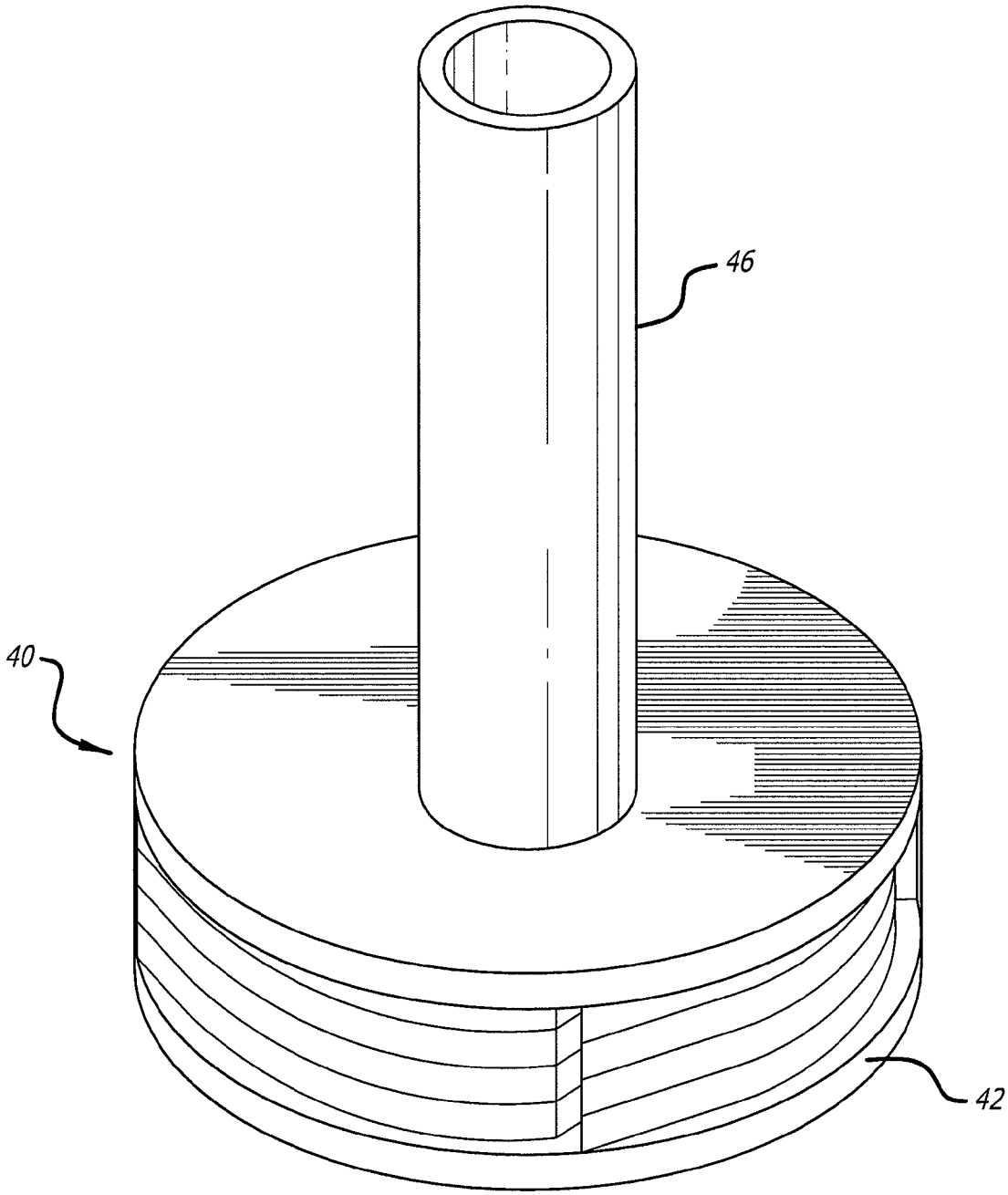
FIG. 3 illustrates a perspective view of the rotor disc shown in FIG. 2 with a central axial axle and a tubular passage for entry of air into the central portion of the disc.

FIG. 3 shows a cylindrical sleeve 46 positioned axially over the cone 44. This cylindrical sleeve 46 directs air into the cavity formed by the vanes 14 in the impeller 40 for entry and distribution of air into the central portion of the impeller 40.

FIG. 4 shows an enhanced impeller 50 which again has stacks of vanes 14 positioned around a flat impeller disc 52. However, here, the central cone is reduced in size and a counter-rotating impeller 54 that has spaced curved blades 56 round the central distribution cone 58. The impeller 54 rotates clockwise while the disc 50 rotates counter clockwise. The advantage of this configuration is that the counter rotating impeller 54 increases the pressure in the fluid, in turn increasing the amount of gas that is entrained in the liquid, and hence increases the amount of gas bubbles that the impeller 50 produces and feeds into the bottom of the column 2010.

Figure 5:
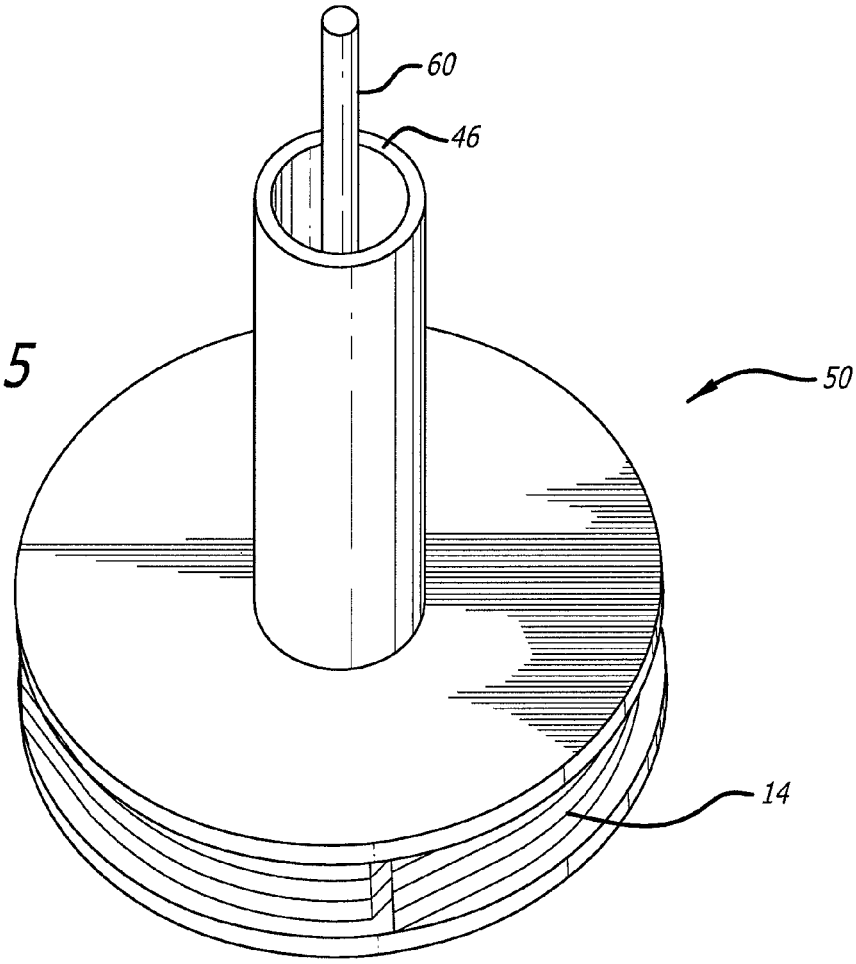
FIG. 5 is a perspective view of the alternative rotor disc shown in FIG. 5 with the central impeller drive shaft and tubular airway shown in place.

FIG. 5 shows a combination of the enhanced impeller 50 with the gas distribution sleeve 46 positioned over the cone 58. A concentric drive axle 60 is fastened to the disc 50 and drives the disc counterclockwise while an internal drive axle drives the clockwise rotation of the disc 54.

Alternative arrangements of the impeller disc shown in FIGS. 1-4 are shown in FIGS. 6*a* and 6*b*. Here the impeller disc 60 is clockwise rotation. At the point of maximum compression which corresponds in FIGS. 1-5 also to the point where the teeth exist, there are tubes 62 that trail in the fluid outside the impeller disc, thus further reducing pressure and enhancing expulsion of compressed gases into the surrounding fluid in which the impeller 60 is immersed. FIGS. 6*a-b* provide additional variations. In FIG. 6*b*, each tube 62 is provided with a smaller tube 64 facing in an opposite direction to increase the water or liquid flow past the point of vacuum or pressure break, thus further enhancing the separation of entrained gas from the liquid in a similar manner to that of a venturi effect. In FIG. 6*b* each tube 62 is further improved with a flared tip 66.

FIGS. 7*a* and 7*b* illustrate a tubular impeller arrangement in which the impeller function is primarily performed by the peripheral tubes 72 simply radially extending from a tube 70. Each tube 72 includes a terminal flare 74 to enhance the vacuum formation effect as the rotating tube 70 turns in the liquid such as water. The gas, in this embodiment is introduced axially through the tube 70.

A third impeller arrangement may be in the form of a screw arrangement 1400 as shown in FIGS. 8 through 14. The assembled screw 1400, as is shown in FIG. 14, in this third model is rotated by a central axial shaft such that the entire assembly rotates as a unit. The teeth 1402 are shown best in FIGS. 12 and 14. The component parts 800, 900 and 1000 of the screw 1400 are separately shown in FIGS. 8, 9 and 10. At FIGS. 9 and 10 we see front and rear views of the same part 900 and at FIG. 11 the two parts 800 and 900 assembled and viewed from the other end in FIG. 11. At FIGS. 12 and 13, which are assembled at the top of FIG. 11, we can see the impeller 1000 which has the cone 1404 which sends air to the entrance holes 1406 into water and teeth 1402 at the external part in the form of a part of a bottom. At FIG. 14 we can see the screw set assembled and including the teeth 1402 at the central flange of part 800. These teeth 1402 on the central flange show that we can make other central surfaces or other levels with the finality of increasing the number of teeth 1402.

Once the screw rotor 1400 is turned (spun) at the bottom of the water column 2010, the screw rotor 1400 operates similarly to that described above with reference to FIGS. 1-5, or the tooth formed by the small tubes in FIGS. 6*a*, 6*b*. The spin of this screw will promote the water to move away (removal) from inside the teeth. When this occurs, a low pressure region is created permitting air introduction. This removal is possible because at the same moment and at the same point, the air is introduced and breaks pressure, allowing the air introduction at the interior part of the tooth. The air creates its own energy and is released from the interior of the tooth towards surface, forming a continuous movement.

The screw rotor 1400 may be modified to a structure wherein some of the teeth 1402 are replaced by bent tubes as in FIGS. 6*a* and 6*b*. This alternative arrangement gives a slightly different flow of air bubbles due to the flow dynamics at the outlets of the tubes.

While the above description contains many particulars, these should not be considered limitations on the scope of the disclosure, but rather a demonstration of embodiments thereof. The process and methods disclosed herein include any combination of the different species or embodiments disclosed. Accordingly, it is not intended that the scope of the disclosure in any way be limited by the above description. The various elements of the claims and claims themselves may be combined in any combination, in accordance with the teachings of the present disclosure, which includes the claims.

The invention claimed is:

1. A method of generating energy comprising:

introducing a gas into a liquid medium below a surface of the liquid medium;

allowing the gas in the liquid medium to rise to the surface;

converting the kinetic energy in the surfacing gas into useable energy;

providing a circular rotor in the water, the rotor having a plurality of teeth on an outer edge of the rotor, a cavity formed within the rotor for the introduction of air, the cavity having a plurality of blades extending towards the outer edge, the blades ending in an orifice in the teeth of the rotor, and a pair of wheels, a chain or belt extending between the wheels and capable of rotating about the wheels; and a plurality of cups attached to the wheel to capture the surfacing gas.

2. The method of claim 1 wherein the liquid is water and introducing the air into water below the surface of the water further comprises providing a low pressure area in the liquid medium and simultaneously compressing air into the low pressure area.

3. The method of claim 2 further comprising rotating the rotor to produce an area of lower pressure at each tooth on the outer edge to provide a vacuum for the introduction of air.

4. The method of claim 2 further comprising a cylindrical sleeve enclosing and axle with lateral ducts in the form of a spiral, the ducts terminating in blades extending into the liquid.

5. The method of claim 4 further comprising rotating the axle within the cylindrical sleeve to produce an area of lower pressure at each blade on the end of the axle to provide a vacuum for the introduction of air.

6. A method of generating energy comprising:

introducing a gas into a liquid medium below a surface of the liquid medium;

allowing the gas in the liquid medium to rise to the surface;

converting the kinetic energy in the surfacing gas into useable energy wherein introducing the air into the liquid below the surface of the liquid further comprises providing a low pressure area in the liquid medium and simultaneously compressing air into the low pressure area;

further comprising a cylinder in the liquid, the cylinder having a plurality of teeth along the circumference of the cylinder, a plurality of orifices in each cylinder, a cavity formed in the cylinder, and having a plurality of vanes extending towards each tooth in the cylinder terminating in an orifice, and a pair of serrated wheels, a chain or belt extending between the wheels and capable of rotating about the wheel; and a plurality of cups attached to the wheel to capture the surfacing gas.

7. The method of claim 6 further comprising rotating the cylinder to produce an area of lower pressure at each tooth on the outer edge of the cylinder to provide a vacuum for the introduction of air.

8. A method of compressing a gas into a liquid medium comprising:

providing a low pressure area in the liquid medium;

simultaneously compressing air into the low pressure area;

providing a circular rotor in the liquid medium, the rotor having a plurality of teeth on an outer edge of the rotor, a cavity formed within the rotor for the introduction of air, the cavity having a plurality of blades extending towards the outer edge, the blades ending in an orifice in the teeth of the rotor, and a pair of wheels, a chain or belt extending between the wheels and capable of rotating about the wheels; and a plurality of cups attached to the wheel to capture the surfacing gas.

9. The method of claim 8 further comprising rotating the rotor to produce a low pressure area at the orifice.

10. The method of claim 8 further comprising a cylindrical sleeve enclosing and axle with lateral ducts in the form of a spiral, the ducts terminating in blades extending into the liquid medium.

11. The method of claim 10 further comprising rotating the axle within the cylindrical sleeve to produce an area of lower pressure at each blade on the end of the axle to provide a vacuum for the introduction of air.

12. A method of compressing a gas into a liquid medium comprising:

providing a low pressure area in the liquid medium;

simultaneously compressing air into the low pressure area;

further comprising a cylinder in the liquid medium, the cylinder having a plurality teeth along the circumference of the cylinder, a plurality of orifices in each cylinder, a cavity formed in the cylinder, and having a plurality of vanes extending towards each tooth in the cylinder terminating in an orifice, and a pair of wheels, a chain or belt extending between the wheels and capable of rotating about the wheels; and a plurality of cups attached to the wheel to capture the surfacing gas.

13. The method of claim 12 further comprising rotating the cylinder to produce an area of lower pressure at each tooth on the outer edge of the cylinder to provide a vacuum for the introduction of the gas.

14. An apparatus generating usable electrical energy comprising:

a tank filled with a liquid medium;

a compressor to introduce a gas having a lower density than the liquid medium into the liquid medium;

air introduction equipment to provide a low pressure area in the liquid medium for low energy compression of the gas;

an energy conversion mechanism attached to an energy conversion axle, the energy conversion mechanism able to capture the surfacing gas;

a generator attached to the energy conversion axle to convert the kinetic energy in the surfacing gas into usable energy;

wherein the air introduction equipment comprises a circular rotor attached to an axle in the liquid medium, the rotor having a plurality of teeth on an outer edge of the rotor, a cavity formed within the rotor for the introduction of air, the cavity having a plurality of blades extending towards the outer edge, the blades ending in an orifice in the teeth of the rotor, and a pair of wheels, a chain or belt extending between the wheels and capable of rotating about the wheels; and a plurality of cups attached to the wheel to capture the surfacing gas.

15. The apparatus of claim 14 wherein the wheels are serrated wheels.

16. The apparatus of claim 14 wherein the cups comprise a cylindrical body portion, the cylindrical body portion terminating in one end with a pair of doors, the doors having a density lower than the liquid medium, and terminating in the other end with widened opening.

17. The apparatus of claim 14 wherein the rotor is rotated in the liquid medium to produce a low pressure area at the orifice.

18. The apparatus of claim 14 wherein the air introduction equipment comprises a cylinder attached to an axle in the liquid medium, the cylinder having a plurality of teeth along the circumference of the cylinder, a plurality of orifices in each cylinder, a cavity formed in the cylinder having a plurality of vanes extending towards each tooth in the cylinder terminating in an orifice.

19. The apparatus of claim 18 further comprising rotating the cylinder to produce an area of lower pressure at each tooth on the outer edge of the cylinder to provide a vacuum for the introduction of the gas.

20. The apparatus of claim 14 wherein the air introduction equipment comprises a cylindrical sleeve enclosing and axle with lateral ducts in the form of a spiral, the ducts terminating in blades extending into the liquid medium.

21. The apparatus of claim 20 further comprising rotating the axle within the cylindrical sleeve to produce an area of lower pressure at each blade on the end of the axle to provide a vacuum for the introduction of air.

22. The apparatus of claim 14 wherein the air introduction equipment is placed into a second liquid tank, the second water tank attached to the tank by an ascendant pipe allowing the gas to travel through the liquid into the tank.

23. A method of generating energy comprising:

introducing a gas into a liquid medium below a surface of the liquid medium;

allowing the gas in the liquid medium to rise to the surface;

converting the kinetic energy in the surfacing gas into useable energy;

providing a circular rotor in the water, the rotor having a plurality of orifices on an outer edge of the rotor, a cavity formed within the rotor for the introduction of air, the cavity having a plurality of blades extending towards the outer edge, the blades having an internal side and an external side and opposite ends between the sides, and the blade ends ending at the orifices of the rotor, each blade being spaced from the center of the rotor such that there is space between the center of the rotor and the internal side of the blades, the space being substantially greater than the width of each blade between the respective internal and external sides, and a pair of wheels, a chain or belt extending between the wheels and capable of rotating about the wheels; and a plurality of cups attached to the wheel to capture the surfacing gas.

24. The method of claim 23 wherein there are several blades set upon each other in a stacked form on a rotor base.

25. The method of claim 23 wherein the trailing edge of each blade is closer to the periphery of the rotor than the leading edge.

26. The method of claim 23 including a cone formation located at the center of the rotor, and extending from a rotor base, the cone being for dispersing air towards the orifices.

27. The method of claim 23 including a second rotor mounted inside the cavity, the second rotor including a second set of blades directed from the center of the rotor and the second set of blades being for rotation oppositely to the rotation of the rotor.

28. A method of generating energy comprising:

introducing a gas into a liquid medium below a surface of the liquid medium;

allowing the gas in the liquid medium to rise to the surface;

converting the kinetic energy in the surfacing gas into useable energy;

providing a circular rotor in the water, the rotor having a plurality of orifices on an outer edge of the rotor, a cavity formed within the rotor for the introduction of air, the cavity having a plurality of blades extending towards the outer edge, the blades having a profile extending in part over a surface area of the rotor, an internal side and an external side and opposite ends between the sides, and the blade ends ending at the orifices of the rotor, each blade being spaced from the center of the rotor such that there is space between the center of the rotor and the internal side of the blades, the outer side being wholly at the periphery of the rotor and the internal side facing the center of the rotor, the external side being substantially parallel to the circumferential periphery of the rotor, and a pair of serrated wheels, a chain or belt extending between the wheels and capable of rotating about the wheels; and a plurality of cups attached to the wheel to capture the surfacing gas.

29. A method of generating energy comprising:

introducing a gas into a liquid medium below a surface of the liquid medium;

allowing the gas in the liquid medium to rise to the surface;

converting the kinetic energy in the surfacing gas into useable energy;

providing a circular rotor in the water, the rotor having a plurality of orifices on an outer edge of the rotor, a cavity formed within the rotor for the introduction of air, the cavity having a plurality of blades extending towards the outer edge, the blades having a profile extending in part over a surface area of the rotor, an internal side and an external side and opposite ends between the sides, and the blade ends ending at the orifices of the rotor, each blade being spaced from the center of the rotor such that there is space between the center of the rotor and the internal side of the blades, the outer side being wholly at the periphery of the rotor and the internal side facing the center of the rotor, the blade ends being a trailing end and leading end in relation to the direction of rotation of the rotor, and wherein the trailing end of one blade overlaps the leading end of the adjacent blade in the direction of rotation, and the leading end being inwardly located relative to the trailing end, and a pair of wheels, a chain or belt extending between the wheels and capable of rotating about the wheels; and a plurality of cups attached to the wheel to capture the surfacing gas.

30. A method of generating energy comprising:

introducing a gas into a liquid medium below a surface of the liquid medium;

allowing the gas in the liquid medium to rise to the surface;

converting the kinetic energy in the surfacing gas into useable energy;

providing a circular rotor in the water, the rotor having a plurality of orifices on an outer edge of the rotor, a cavity formed within the rotor for the introduction of air, the cavity having a plurality of blades extending towards the outer edge, the blades having a profile extending in part over a surface area of the rotor, an internal side and an external side and opposite ends between the sides, and the blade ends ending at the orifices of the rotor, each blade being spaced from the center of the rotor such that there is space between the center of the rotor and the internal side of the blades, the outer side being wholly at the periphery of the rotor and the internal side facing the center of the rotor, the blade ends being a trailing end and leading end in relation to the direction of rotation of the rotor, and wherein the trailing end of one blade overlaps the leading end of the adjacent blade in the direction of rotation, and there being an interface between the blades at the overlap, and the interface being the orifice and presenting an angle on the side facing the outer periphery of the rotor between the two adjacent blades being relatively less acute than an acute angle facing inwardly at the interface, and a pair of wheels, a chain or belt extending between the wheels and capable of rotating about the wheels; and a plurality of cups attached to the wheel to capture the surfacing gas.

31. A method of generating energy comprising:

introducing a gas into a liquid medium below a surface of the liquid medium;

allowing the gas in the liquid medium to rise to the surface;

converting the kinetic energy in the surfacing gas into useable energy;

providing a circular rotor in the water, the rotor having a plurality of orifices on an outer edge of the rotor, a cavity formed within the rotor for the introduction of air, a peripheral ring upstanding from a rotor base and being around the cavity, the ring forming an outer circumference of the rotor, and a series of apertures from the ring for passing air from the cavity to the area outside the ring, each aperture including a tube directed in a relatively trailing direction in relation to the direction of rotation of the rotor the rotor, and a pair of wheels, a chain or belt extending between the wheels and capable of rotating about the wheels; and a plurality of cups attached to the wheel to capture the surfacing gas.

32. The method of claim 31 including a venturi from each tube.

33. A method of generating energy comprising:

introducing a gas into a liquid medium below a surface of the liquid medium;

allowing the gas in the liquid medium to rise to the surface;

converting the kinetic energy in the surfacing gas into useable energy;

providing a circular tube for rotation in the water, the tube having a plurality of orifices on an outer edge of the tube, peripheral tubes from a wall of the tube, each peripheral tube being connected with one of a series of apertures from the tube for passing air from the tube to the area outside the tube, each peripheral tube being directed in a relatively trailing direction in relation to the direction of rotation of the tube, and a pair of wheels, a chain or belt extending between the wheels and capable of rotating about the wheels; and a plurality of cups attached to the wheel to capture the surfacing gas.

34. A method of generating energy comprising:

introducing a gas into a liquid medium below a surface of the liquid medium;

allowing the gas in the liquid medium to rise to the surface;

converting the kinetic energy in the surfacing gas into useable energy;

providing a circular rotor in the water, the rotor having a plurality of teeth towards an outer edge of the rotor, and formed on a surface of the rotor, such that air introduced into a cavity formed with the rotor for receiving the introduction of air, is expelled through the teeth, each tooth including an orifice connected to the cavity of the rotor, and a pair of wheels, a chain or belt extending between the wheels and capable of rotating about the wheels; and a plurality of cups attached to the wheel to capture the surfacing gas.

* * * * *